United States Patent [19]

Waltrip

[11] 4,239,161

[45] Dec. 16, 1980

[54] COKE GRINDER

[75] Inventor: Owen R. Waltrip, Roseville, Calif.

[73] Assignee: Nuclear Supreme, Casper, Wyo.

[21] Appl. No.: 24,327

[22] Filed: Mar. 27, 1979

[51] Int. Cl.[3] ..... B02C 18/18

[52] U.S. Cl. ..... 241/46.02; 241/280; 241/282.2

[58] Field of Search ..... 144/230; 241/21, 28, 241/46 R, 46.02, 46.06, 82.5, 92, 221, 222, 277, 280, 282.2, 292.1, 34, 189 R

[56] References Cited

U.S. PATENT DOCUMENTS

| | | | |
|---|---|---|---|
| Re. 26,871 | 4/1970 | Morkoski et al. | 241/292.1 X |
| 416,869 | 12/1889 | Smith | 144/230 X |
| 678,837 | 7/1901 | Griffin | 241/222 X |
| 2,282,887 | 5/1942 | Roberts | 241/280 X |
| 2,659,537 | 11/1953 | Keon | 241/222 |
| 3,268,178 | 8/1966 | Schoeppner | 241/189 R |
| 3,830,269 | 8/1974 | Morse | 144/230 X |
| 3,866,645 | 2/1975 | Sybertz | 241/292.1 X |

*Primary Examiner*—Mark Rosenbaum
*Attorney, Agent, or Firm*—Clarence A. O'Brien; Harvey B. Jacobson

[57] ABSTRACT

Coke logs are fed into a housing through an infeed opening at a regulated rate to control the particle size to which the coke is reduced by comminution in response rotation of a bladed rotor operatively positioned adjacent to the infeed opening. Water injected under pressure into the housing forms a slurry with the coke particles discharged from a bottom outlet opening of the housing.

8 Claims, 5 Drawing Figures

COKE GRINDER

BACKGROUND OF THE INVENTION

This invention relates to the comminution of solid material and more particularly to the reduction of coke to particle size for use in a slurry.

Apparatus of the bladed rotor type for communicating solid material is well known as disclosed, for example, in U.S. Pat. No. Re. 26,871, U.S. Pat. Nos. 3,830,269 and 3,866,645. In this type of apparatus, cutter blades project at a forward angle from a rotor and have outer beveled cutting tips which cut, chip or comminute solids into chips or particles of reduced size in response to rotation of the rotor. The cutter blades are removably anchored to the rotor hub by threaded fasteners. Solid material such as wood is displaced into the path of the cutting tips of the blades to effect comminution.

Because of the blade loading and material handling problems, comminuting apparatus of the foregoing type has not been utilized for size reduction of material such as coke. Instead, ball grinding apparatus are commonly used, However, ball grinders do not possess the operational speed and size reduction control capabilities of bladed rotor types of apparatus.

Accordingly, it is an important object of the present invention to provide a bladed rotor type of comminuting device suitable for the grinding and handling of coke.

SUMMARY OF THE INVENTION

In accordance with the present invention, material such as coke logs are fed at a controlled infeed rate into a housing enclosing a bladed rotor operatively positioned adjacent the infeed or inlet opening to comminute the coke into particle size in response to rotation of the rotor. Water under pressure is injected through a smaller inlet opening into the housing in opposing relation to the infeed of the coke to form a slurry with the comminuted coke particles. The slurry is gravitationally discharged from the housing through a bottom opening below the rotor.

The coke is reduced in size by cutting blades projecting at a forward angle of 30° from the rotor hub to present radially outer, beveled tips that rapidly pass the fixed, annular edge formed in the housing at the infeed opening. The infeed rate of coke controls the size reduction while the pressurized inflow of water maintains the apparatus in operation by removal of heat and particles from the cutting zone. The loading imposed on the blades is sustained by reception of the blades in rotor slots intersected by radial setscrew anchors circumferentially spaced between the blades.

These, together with other objects and advantages which will become subsequently apparent, reside in the details of construction and operation as more fully hereinafter described and claimed, reference being had to the accompanying drawings forming a part hereof, wherein like numerals refer to like parts throughout.

DETAILED DESCRIPTION OF SPECIFIC EMBODIMENT

Figure 1:
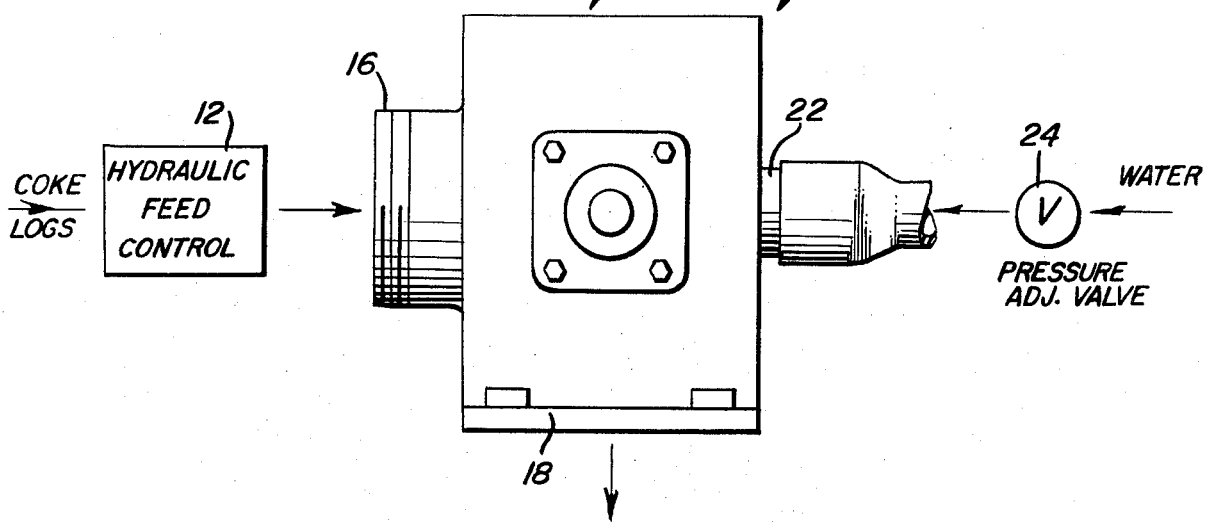
FIG. 1 is a side elevation view of the coke grinding device and associated apparatus shown schematically.
Figure 2:
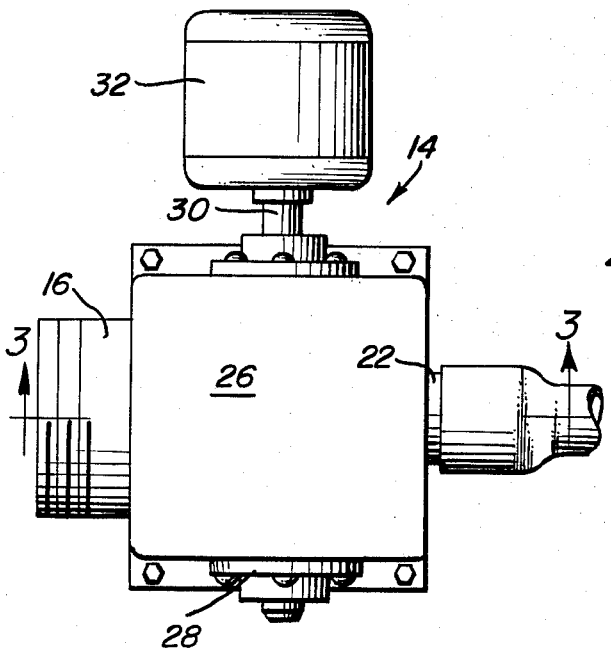
FIG. 2 is a top plan view of the coke grinding device shown in FIG. 1.

Referring now to the drawings in detail, FIGS. 1 and 2 illustrate the apparatus of the present invention generally referred to by reference numeral 10. This apparatus is designed to comminute or grind solid material, such as coke logs into particle form for transport in a water slurry to a desired location. Thus, the coke logs as diagrammed in FIG. 1 are fed at a controlled infeed rate, determined by a hydraulic feed control component 12 of any well known type, to a coke grinding device generally referred to by reference numeral 14. The solid material enters the coke grinder 14 through an infeed inlet 16 and comminuted material is discharged from an outlet opening at the bottom 18. The discharge from the bottom outlet opening is in the form of a slurry consisting of the communited coke particles in water. Water is therefore injected into the coke grinder 14 through a second inlet 22. The water enters the inlet 22 under pressure from a suitable source, the pressure being adjusted by means of a pressure adjusting valve 24.

Figure 3:
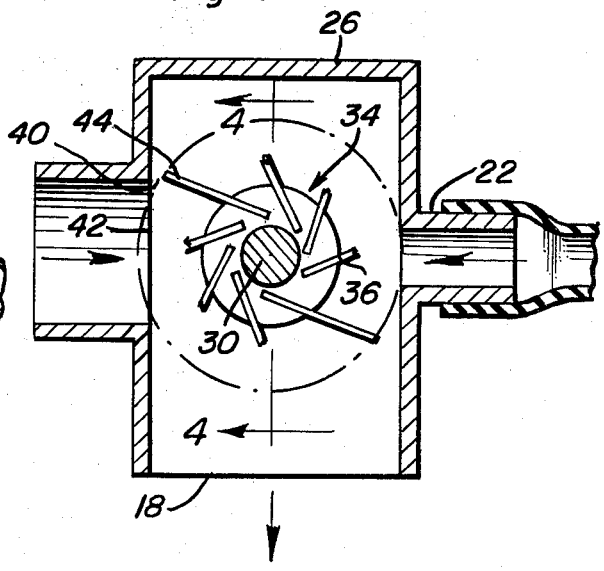
FIG. 3 is a partial side section view taken substantially through a plane indicated by section line 3—3 in FIG. 2.

As more clearly seen in FIG. 2, the material infeed inlet 16 and water injecting inlet 22 are in the form of conduit sections extending axially from opposite sides of a housing 26. Mounted on the sides of the housing perpendicular to the inlets 16 and 22, are a pair of pressure sealed bearings 28 rotatably mounting a power shaft 30 adapted to be driven by any suitable prime motor such as electric motor 32. The power shaft 30 is connected to a bladed rotor assembly located within the housing and generally referred to by reference numeral 34 as shown in FIG. 3. The bladed rotor assembly includes a rotor body or hub 36 to which the power shaft is secured and from which a plurality of cutting blades 38 project. The rotor is operatively positioned by means of the shaft bearings 28 so that its rotational axis extends perpendicular to, but in line with the opposing inlets 16 and 22. Further, the bearings 28 are arranged to operatively locate the rotor assembly so that a minimum clearance gap 40 is established between the bladed rotor assembly and a fixed annular cutting edge 42 formed by the intersection of the inlet 16 with the housing. It will be apparent, therefore, that at the solid material is fed past the fixed edge 42, it will be cut or reduced in size by the rapidly moving cutting tips 44 at the radially outer ends of the blades 38 in response to rotation of the rotor assembly.

As more clearly seen in FIG. 3, the diameter of the material infeed inlet 16 is substantially larger than that of the water inlet 22. According to one embodiment of the invention, the internal diameter of the inlet 16 is six inches as compared to a $\frac{5}{8}$ inch internal diameter for the water inlet 22. The cutter blades 38 are $\frac{3}{8}$ inch thick and the rotor assembly is driven at a speed of 1850 rpm. Water is introduced through inlet 22 under a nominal pressure of 50 psi. The rotor hub 36 from which the blades 38 extend, is 2-$\frac{5}{8}$ inches in diameter.

Figure 4:
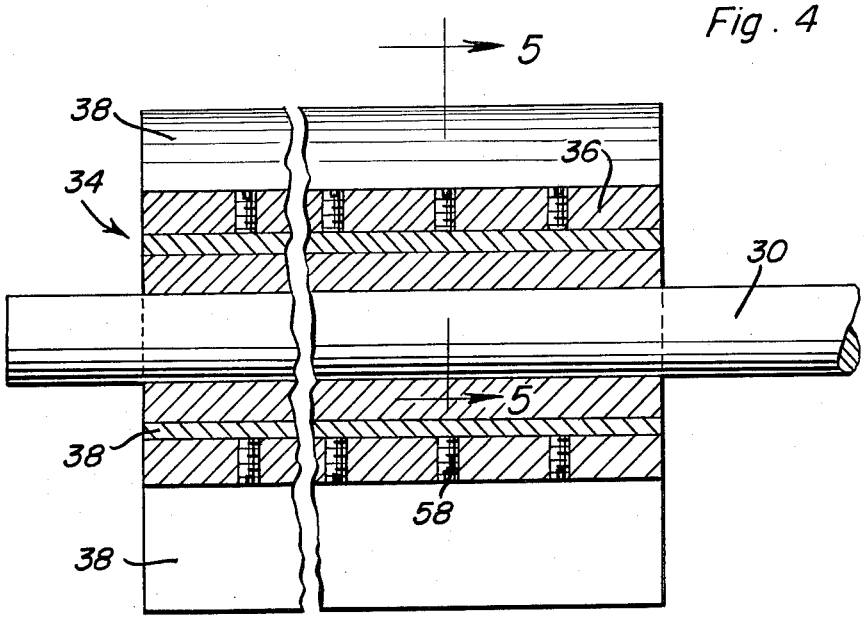
FIG. 4 is an enlarged side elevation view of the bladed rotor as viewed from the section line 4—4 in FIG. 3.
Figure 5:
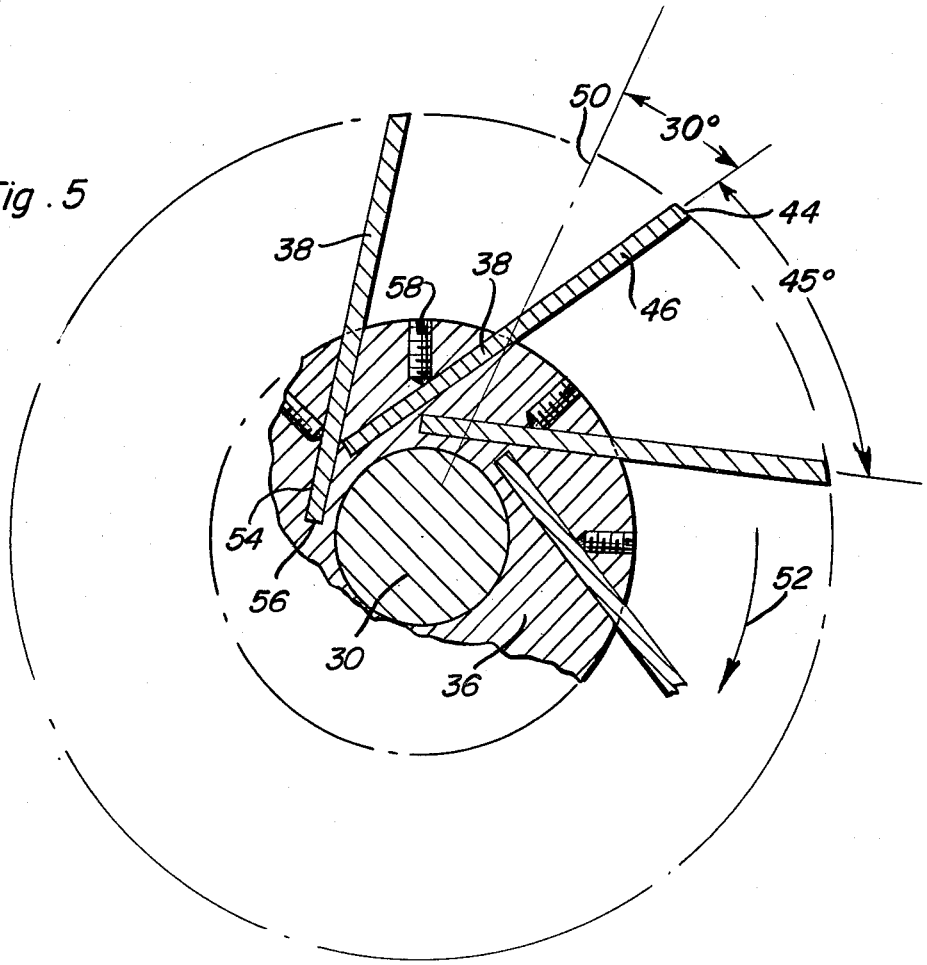
FIG. 5 is an enlarged transverse section view takken substantially through a plane indicated by section line 5—5 in FIG. 4.

Referring now to FIGS. 4 and 5, the cutter blades 38 are mounted on the rotor hub 36 in equi-angular spaced relationship to each other. In the embodiment illustrated, eight cutter blades are utilized so that the angular spacing therebetween is 45°. Each blade 38 has a forward side 46 that extends from the outer cylindrical surface 48 of the rotor hub at a forward angle of 30° to the radial line 50 in the direction of rotation indicated by arrow 52. The cutting tip 44 at the radially outer end of the blade is beveled in trailing relation to the forward side 46 and its edge surface lies substantially in a circle coaxial with the outer cylindrical surface 48 of the rotor assembly.

Each cutting blade is positioned in the rotor hub by means of a slot 54 formed therein having a terminal end abutting the radially inner end 56 of the blade. The blade is anchored within its slot by means of a setscrew 58 that is received within a threaded bore extending radially from the outer cylindrical surface 48 inwardly to intersect the slot 54. Each setscrew anchor 58 engages a blade intermediate its ends and is aligned with the radially inner end 56 of an adjacent blade as clearly seen in FIG. 5. A plurality of axially spaced setscrew anchors 58 engage each blade 38 as more clearly seen in FIG. 4. The setscrew anchors are positioned circumferentially between the blades as shown in FIG. 5.

As a result of the foregoing arrangement, the high loading imposed on the blades is accommodated. Further, the blades are readily replaced by the removal of the setscrew anchors. Also, the cutting tips of the blades are self-sharpening and overloading of the grinding device is prevented by the constant inflow of water under pressure removing both heat from the cutting zone as well as to prevent accumulation of particles.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. In a device for comminuting coke logs, including a housing having an infeed opening therein forming a fixed cutting edge, and a rotor body enclosed within the housing and rotatable in one direction about a rotational axis, said rotor body having an outer cylindrical surface from which a plurality of cutting blades project, each of said cutting blades having an outer cutting tip radially spaced from the outer surface and a radially inner end, the improvement residing in slot means formed in the rotor body for holding each of said blades at a predetermined forward angle at the outer surface in the direction of rotation relative to a radial line extending from the rotational axis, anchoring means extending radially into the rotor body from said outer surface between the blades for engagement with each of said blades intermediate the outer cutting tip and the inner end, and means connected to the housing for introducing coke logs at a predetermined infeed rate through said infeed opening in a direction transverse to said rotational axis, said housing having an outlet opening positioned below the infeed opening from which coke is gravitationally discharged.

2. The combination of claim 1 wherein said outer cutting tips of the blades are beveled in trailing relation to said direction of rotation to form edge surfaces substantially coaxial with the outer cylindrical surface of the rotor body.

3. The combination of claim 2 wherein said predetermined forward angle of the blade is approximately 30°.

4. The combination of claim 3 including means for injecting water into the housing to form a slurry with the comminuted coke discharged from the opening.

5. The combination of claim 1 including means for injecting water into the housing to form a slurry with the comminuted coke discharged from the outlet opening.

6. Apparatus for comminuting coke logs comprising a housing having a pair of inlets and an outlet from which material is discharged in a direction transverse to infeed through one of the inlets, a bladed rotor enclosed within said housing, means mounting the rotor about an axis perpendicular to said infeed through said one of the inlets for comminuting the coke logs introduced into the housing in response to rotation of the rotor, feed control means connected to said one of the inlets for regulating particle size of the comminuted coke as a function of the rate of infeed of the material through said one of the inlets, and means connected to the other of said inlets for injecting water under pressure into the housing in opposing relation to the infeed to form a slurry with the comminuted coke discharged from the outlet.

7. The combination of claim 6 wherein said one of the inlets forms an annular cutting edge closely spaced from the bladed rotor by a minimum clearance gap.

8. The combination of claim 7 wherein said bladed rotor includes a hub having an outer cylindrical surface, and a plurality of blades projecting from the hub at forward angles of 30° in the direction of rotation of the rotor.

* * * * *